US006183315B1

(12) United States Patent
McHugh et al.

(10) Patent No.: US 6,183,315 B1
(45) Date of Patent: Feb. 6, 2001

(54) BOARD-TO-BOARD CONNECTOR ASSEMBLY

(75) Inventors: Robert G. McHugh, Everygreen, CO (US); Yu-Ming Ho, Chandler, AZ (US); Hung-Chi Yu, Hsi-Chih (TW)

(73) Assignee: Hon Hai Precision Ind. Co., Ltd., Taipei Hsein (TW)

( * ) Notice: Under 35 U.S.C. 154(b), the term of this patent shall be extended for 0 days.

(21) Appl. No.: 09/495,045

(22) Filed: Jan. 31, 2000

Related U.S. Application Data

(62) Division of application No. 08/773,690, filed on Dec. 27, 1996, now Pat. No. 6,036,504.

(51) Int. Cl.[7] ..... H01R 24/00
(52) U.S. Cl. ..... 439/752; 439/660; 439/74
(58) Field of Search ..... 439/660, 74, 62, 439/692, 752, 701

(56) References Cited

U.S. PATENT DOCUMENTS 5,192,232 * 3/1993 Lenz et al. ..... 439/660
5,277,597 * 1/1994 Masami et al. ..... 439/660
5,433,616 * 7/1995 Walden ..... 439/62
5,556,286 * 9/1996 Ikesugi et al. ..... 439/74
5,626,482 * 5/1997 Chan et al. ..... 439/74
5,839,923 * 11/1998 Yoshida ..... 439/752
6,045,413 * 4/2000 Creux ..... 439/752
6,066,008 * 5/2000 Brantingham et al. ..... 439/752

* cited by examiner

*Primary Examiner*—Paula Bradley
*Assistant Examiner*—Alexander Gilman
(74) *Attorney, Agent, or Firm*—Wei Te Chung

(57) ABSTRACT

A pair of board-to-board connectors (10, 30) including a receptacle connector (10) and a plug connector (30). The receptacle connector (10) includes an insulative first housing (12) having a plurality of first passageways (14) for receiving a corresponding number of first contacts (16) therein, respectively. Each first contact (16) is of a resilient bellow type and the distal end (22) thereof abuts against the butting wall (26) of the housing (12) for pre-loading consideration, thus controlling the contact gap for mating. The plug connector (30) includes an insulative second housing (32) having a plurality of second passageways (34) for receiving a corresponding number of second contacts (36) therein, respectively. Each second contact (36) is of a stiff stick type and the distal end (42) thereof abuts against the side wall (44) of the housing (32) for confronting the mated corresponding first contact (16). A pair of lateral projections (48, 50) are formed at either end of each housing (12, 32) for protecting the tails of (20, 40) the contacts (16, 36) therebetween.

4 Claims, 8 Drawing Sheets

BOARD-TO-BOARD CONNECTOR ASSEMBLY

CROSS REFERENCE APPLICATION

This is a divisional application of Ser. No. 08/773,690, filed Dec. 27, 1996, now a U.S. Pat. No. 6,036,504, issued Mar. 14, 2000.

BACKGROUND OF THE INVENTION

1. Field of the Invention

The invention relates to a board-to-board connector assembly, and particularly to a pair of plug and receptacle connectors mating with each other.

2. The Related Art

Board-to-board connectors may be referred to U.S. Pat. Nos. 5,224,866, 5,310,357, 5,433,616, 5,393,250, 5,478,248, 5,545,051 and 5,556,286. Anyhow, an object of the invention is to provide a pair of board-to-board receptacle and plug connectors which are adapted to be reliably and securely coupled to each other.

SUMMARY OF THE INVENTION

According to an aspect of the invention, a pair of board-to-board connectors including a receptacle connector and a plug connector. The receptacle connector includes an insulative first housing having a plurality of first passageways for receiving a corresponding number of first contacts therein, respectively. Each first contact is of a resilient bellow type and the distal end thereof abuts against the butting wall of the housing for pre-loading consideration, thus controlling the contact gap for mating. The plug connector includes an insulative second housing having a plurality of second passageways for receiving a corresponding number of second contacts therein, respectively. Each second contact is of a stiff stick type and the distal end thereof abuts against the side wall for confronting the mated corresponding first contact. A pair of lateral projections are formed at either end of each housing for protecting the tails of the contacts therebetween.

Another object of the invention is to provide an extension type receptacle connector which has an increased height wherein to stabilize the longer body of the contact, a supporting block is inserted into the cavity of the housing for full engagement with the body of the contact so that the contact can be stably and reliably retained within the corresponding passageway for efficiently resisting the improper impact.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
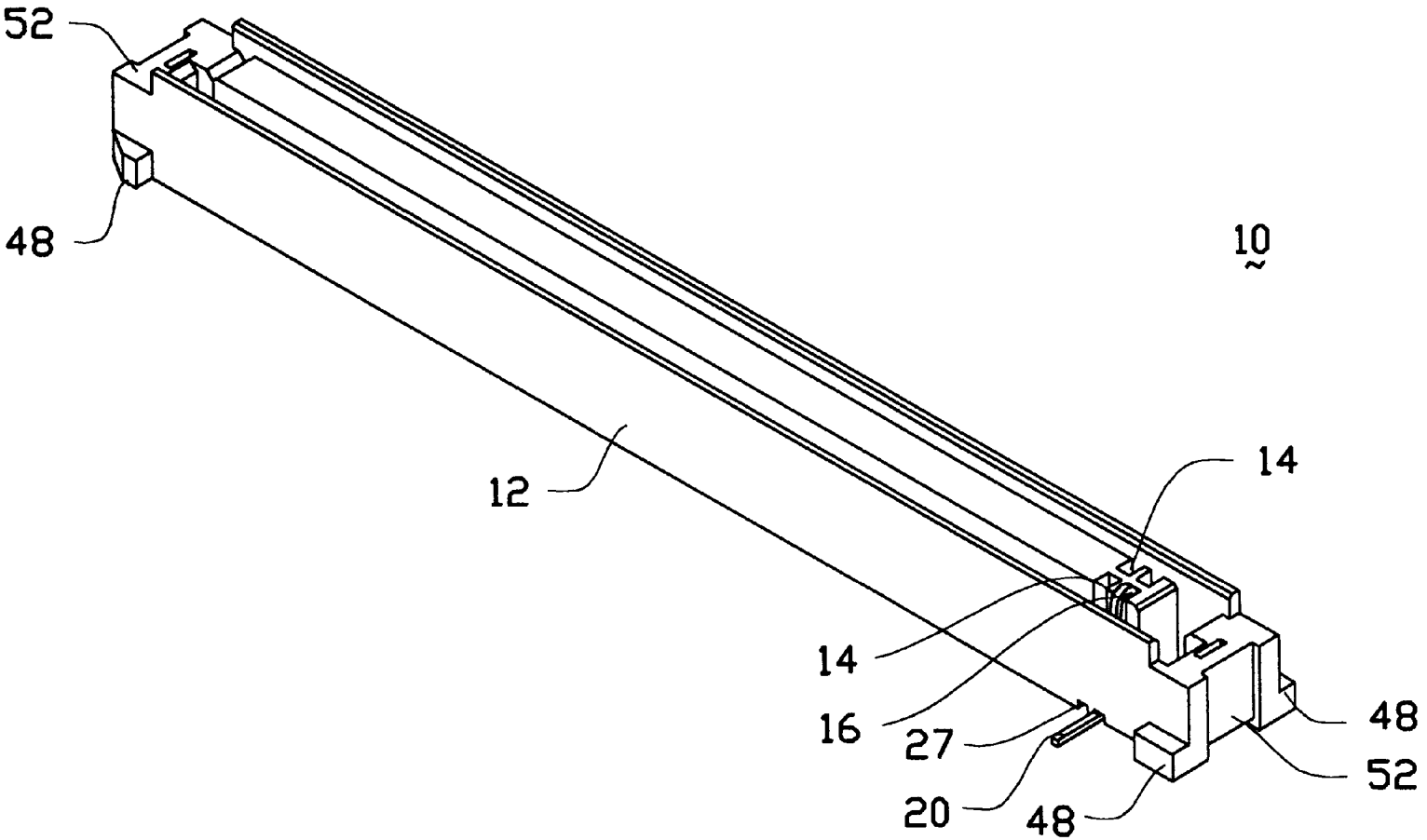
FIG. 1 is a perspective view of a receptacle connector according to the invention (only one contact shown).
Figure 3:
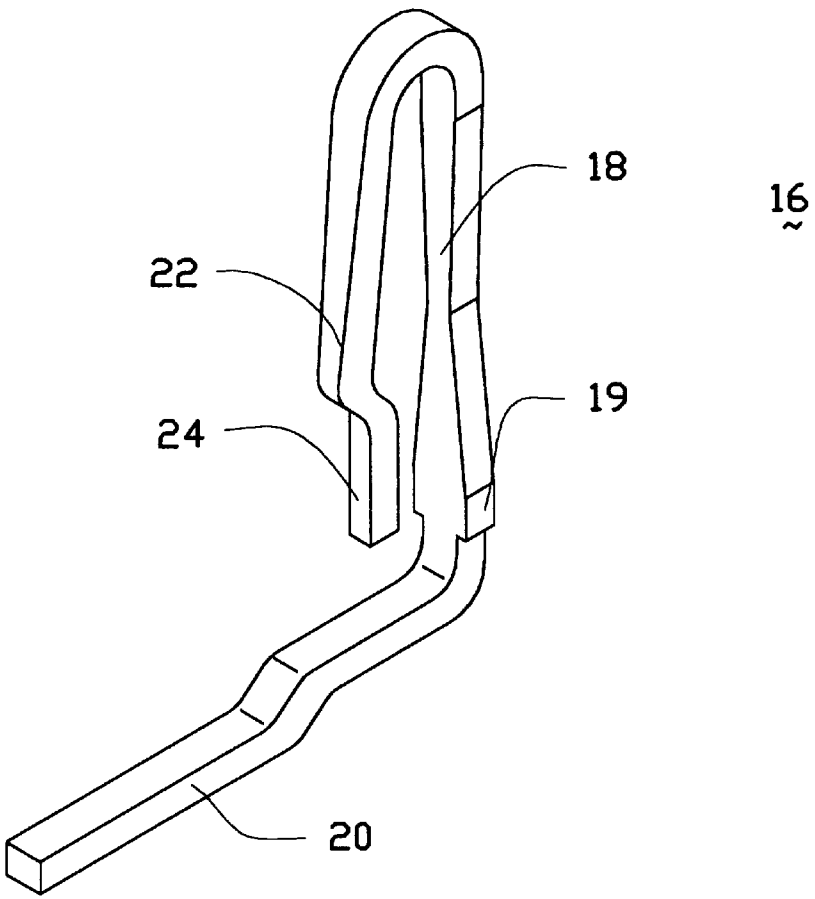
FIG. 3 is a perspective view of the resilient contact used within the receptacle connector of FIG. 1.
Figure 5:
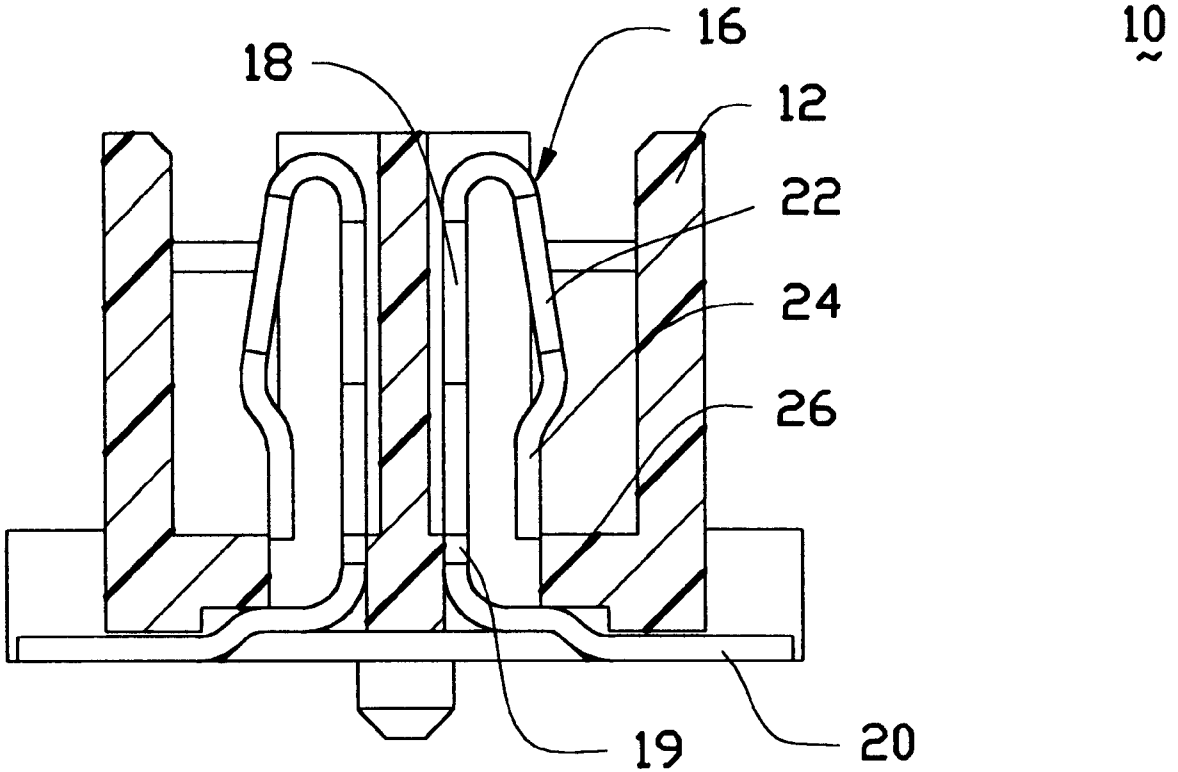
FIG. 5 is a cross-sectional view of the resilient contact embedded within the housing of the receptacle connector of FIG. 1.

It will be noted here that for a better understanding, most of like components are designated by like reference numerals throughout the various figures in the embodiments. Attention is directed to FIG. 1 wherein a receptacle connector 10 includes an insulative first housing 12 defining two rows of first passageways 14 for receiving a corresponding number of resilient first contacts 16 therein. Also referring to FIGS. 3 and 5, each first contact 16 includes a main body 18 with retention barbs 19 on two sides, a solder tail 20 horizontally extending from the bottom of the main body 18, and an engagement section 22 curvilinearly downward extending from the top of the main body 18 wherein the distal end 24 of the engagement section 22 of the contact 16 abuts against a bottom wall 26 for pre-loading consideration.

Figure 2:
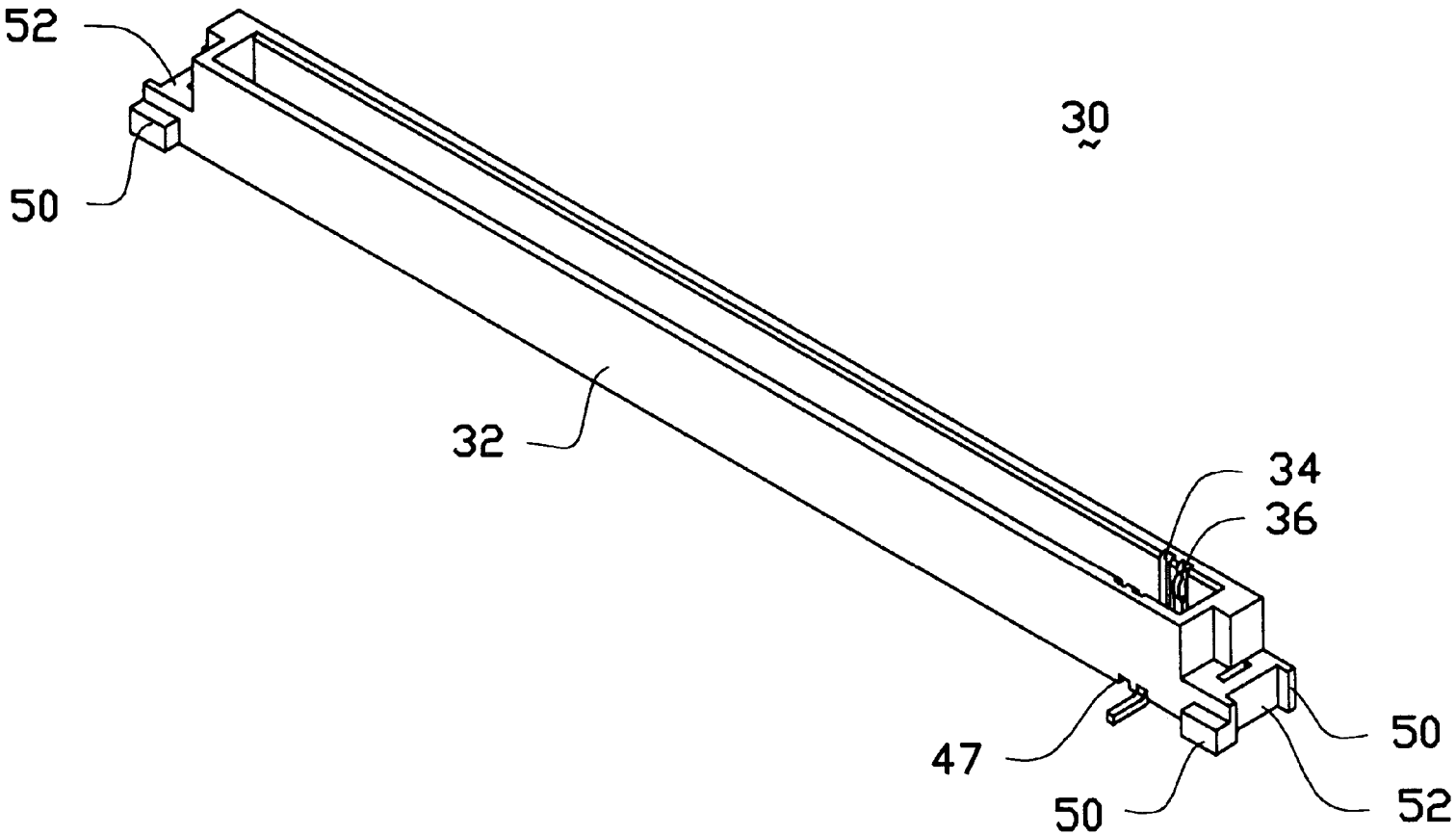
FIG. 2 is a perspective view of a plug connector according to the invention (only one contact shown).
Figure 4:
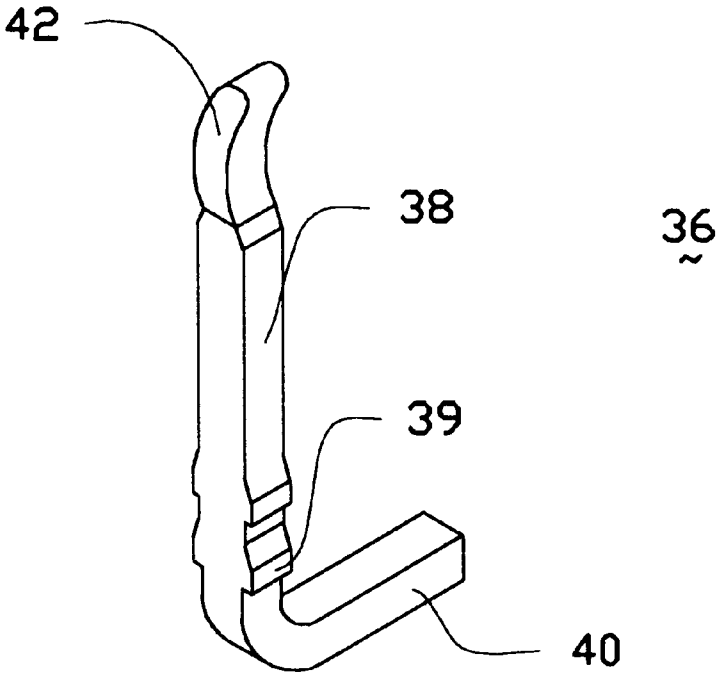
FIG. 4 is a perspective view of the stiff contact used within the plug connector of FIG. 1.
Figure 6:
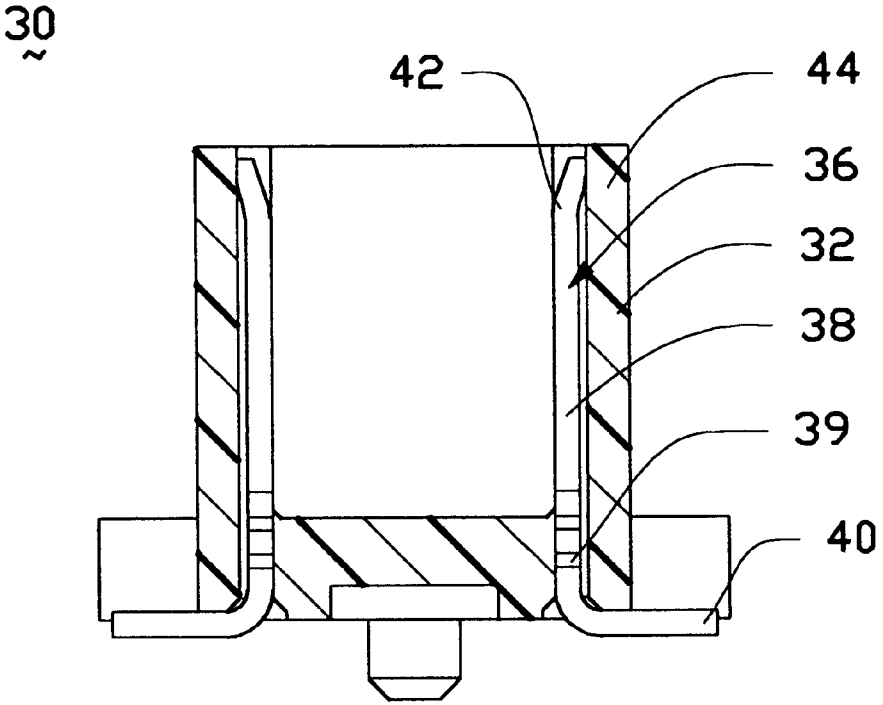
FIG. 6 is a cross-sectional view of the stiff contact embedded within the housing of the plug connector of FIG. 2.

Oppositely, referring to FIG. 2, a plug connector 30 includes an insulative second housing 32 defining two rows of second passageways 34 for receiving a corresponding number of stiff second contacts 36 therein. Also referring to FIGS. 4 and 6, each second contact 36 includes a main body 38, with retention barbs 39 on two sides, from which a solder tail 40 horizontally extends from the bottom and a distal end 42 abuts against the side wall 44 of the housing 32.

Figure 7:
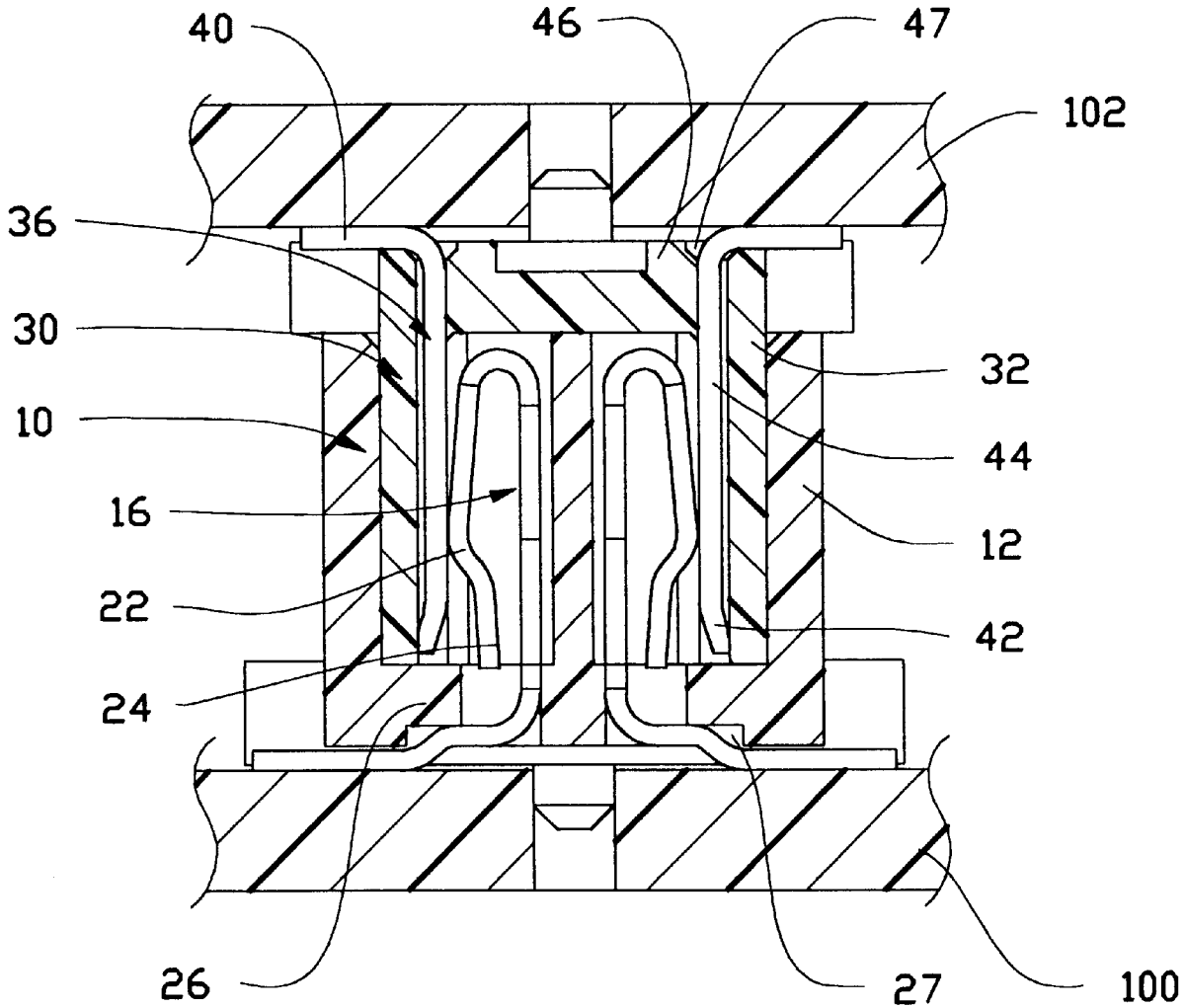
FIG. 7 is a cross-sectional view of the coupled receptacle and plug connectors.

Referring to FIG. 7, when the receptacle connector 10 and the plug connector is mated with each other, the engagement section 22 of the first contact 16 can be deflected inward by the second contact 36 so that the distal end 24 thereof is disengaged from the bottom wall 26 of the receptacle connector 10.

To efficiently hold the solder tails 20 in position with regard to the board 100 on which the receptacle connector 10 is mounted, the bottom wall 26 has a plurality of slots 27 (FIGS. 1, 7) on the surface. Similarly, the plug connector 30 has the slots 47 on the bottom wall 46 (FIGS. 2, 7).

The receptacle connector 10 (FIG. 1) includes a pair of lateral projections 48 at either end of the housing 12 for protecting the solder tails 20 between two opposite projections 48 on each side. Similarly, the plug connector 30 (FIG. 2) also is provided with two pairs of lateral projections 50 at two opposite ends of the housing 32.

Each connector 10, 30 has a pair of mounting ears 52 at two ends of the housing 12, 32 for securing the connector 10, 30 on the corresponding board 100, 102.

Figure 8:
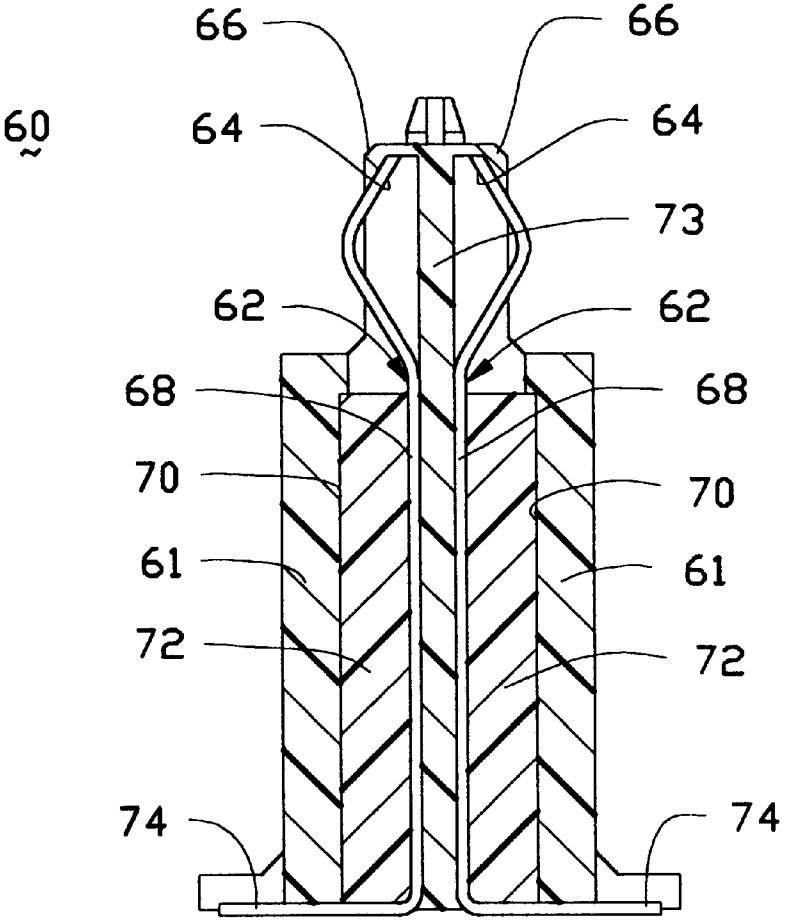
FIG. 8 is a cross-sectional view of a second embodiment of a receptacle connector having an increased height with a pair of stabilization block inserted into the cavities from the back before the solder tails of the contacts have been bent at a right angle.

FIG. 8 shows a vertically extended receptacle connector 60 comprising a housing 61 wherein a center wall 73 extends upward from a bottom of the housing 61 and cooperates with a peripheral wall of the housing 61 for retaining two rows of contacts 62. A top shielding end 66 of the center wall 73 extends upward beyond the peripheral wall of the housing 61. Each of the contacts 62 is of a cantilever type having a curved distal end 64 extending beyond the peripheral wall and engaged with the top shielding end 66 of the center wall 73 for pre-loading consideration before mating with the plug connector 30. The contact 62 includes an elongated main body 68 which is exposed to the cavity 70 inside the housing 61. The reason why the cavities 70 are made is to keep the thickness along the whole housing 61 uniform in order not to result in any warp during molding. To prevent the exposed elongated main body 68 from moving with regard to the housing 61 in the cavity 70, a pair of stabilization blocks 72 are inserted into the corresponding cavities 70, respectively, from a bottom entry thereof for retainably pressing against the main bodies 68 of the contacts 62. In this embodiment, the main body 68 abuts against the center wall 73 so that the solder tail 74 of the contact 62 should be bent to its final horizontal position after the blocks 72 have been installed into the housing 61.

Figure 9:
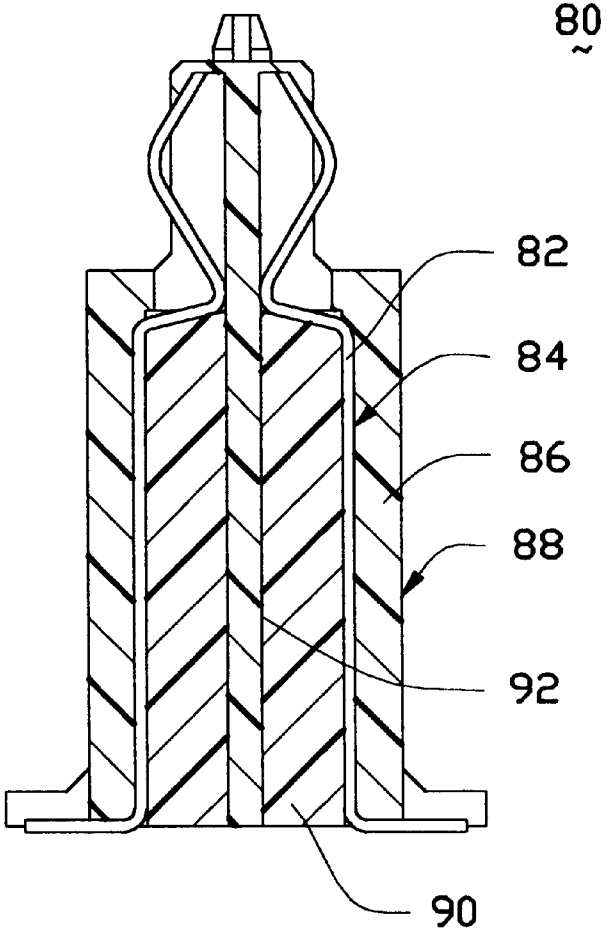
FIG. 9 is a cross-sectional view of a third embodiment of a receptacle connector having an increased height with a pair of reinforcement block inserted into the rear cavities from the back.

FIG. 9 shows a third embodiment of the receptacle connector 80 wherein the main body 82 of the contact 84 abuts against the side wall 86 of the housing 88, so that the reinforcement or stabilization block 90 can be installed into the corresponding cavity 92 from a bottom entry thereof at the last step during manufacturing or assembling.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. A vertically extending electrical connector comprising:

an insulative housing defining a plurality of passageways for receiving a corresponding number of cantilever contacts therein;

two cavities formed by two sides of a center wall which extends upward from a bottom portion of the housing wherein the center wall has a shielding end extending beyond a peripheral wall of the housing;

each of said cantilever contacts including a main body abutting against the center wall and exposed to one of said cavities and a curved distal end extending from the main body beyond the peripheral wall of the housing and engaging with the shielding end of the center wall for pre-loading before mating with a complementary connector; and two stabilization blocks inserted into the corresponding cavities, respectively, from a bottom entry thereof, to press against the corresponding main body of each cantilever contact wherein each of the cantilever contacts further includes a solder tail which is formed cross the corresponding cavity by bending after the stabilization blocks have been installed.

2. A vertically extending electrical connector comprising:

an insulative housing defining a plurality of passageways for receiving a corresponding number of cantilever contacts therein;

two cavities formed by two sides of a center wall which extends upward from a bottom portion of the housing, wherein the center wall has a shielding end extending beyond peripheral walls of the housing;

each of said cantilever contacts including a main body abutting against a corresponding side wall and exposed to one of said cavities, a curved distal end extending from the main body beyond the peripheral wall of the housing and engaging with the shielding end of the center wall for pre-loading before mating with a complementary connector, and a horizontally extending solder tail; and two stabilization blocks inserted into the corresponding cavities, respectively, from a bottom entry thereof, to press against the corresponding main body of each cantilever contact wherein the horizontally extending solder tail will not hinder the blocks from being inserted into the corresponding cavities.

3. A vertically extending electrical connector comprising:

an insulative housing defining a plurality of passageways for receiving a corresponding number of cantilever contacts therein;

two cavities formed by two sides of a center wall on a rear portion of the housing;

each of said cantilever contacts including a main body abutting against the center wall and exposed to one of said cavities; and two stabilization blocks inserted into the corresponding cavities respectively from the bottom, each of said blocks pressing against the corresponding main body of each cantilever contact and having said main body sandwiched between the center wall and the block wherein each of the cantilever contacts further includes a solder tail which is formed cross the corresponding cavity by bending after the stabilization blocks have been installed.

4. A vertically extending electrical connector comprising:

an insulative housing defining a plurality of passageways for receiving a corresponding number of cantilever contacts therein;

two cavities formed by two sides of the center wall on a rear portion of the housing;

each of said cantilever contacts including a main body abutting against the center wall and exposed to one of said cavities; and two stabilization blocks inserted into the corresponding cavities respectively from the bottom, each of said blocks pressing against the corresponding main body of each cantilever contact and having said main body sandwiched between the center wall and the corresponding side wall wherein the horizontally extending solder tail will not hinder the blocks from being inserted into the corresponding cavities.

* * * * *